US006482074B1

(12) United States Patent
Chang et al.

(10) Patent No.: US 6,482,074 B1
(45) Date of Patent: Nov. 19, 2002

(54) APPARATUS AND METHOD FOR TRANSFERRING A TORQUE FROM A ROTATING HUB FRAME TO A HUB SHAFT

(75) Inventors: Yi-Sen Chang, Chu-tung (TW); Hsien-Shu Tsai, Hsin Chu (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 0 days.

(21) Appl. No.: 09/729,298

(22) Filed: Dec. 4, 2000

(51) Int. Cl.[7] ..... B24B 1/00; B24B 7/19

(52) U.S. Cl. ..... 451/28; 451/41; 451/56; 451/443

(58) Field of Search ..... 451/28, 41, 56, 451/72, 360, 443

(56) References Cited

U.S. PATENT DOCUMENTS 6,193,587 B1 * 2/2001 Lin et al. ..... 451/287

* cited by examiner

*Primary Examiner*—Timothy V. Eley
*Assistant Examiner*—Alvin J. Grant
(74) *Attorney, Agent, or Firm*—Tung & Associates

(57) ABSTRACT

An apparatus and a method for transferring a rotational torque from a hub frame to a hub shaft onto which a pad conditioning disc is attached are disclosed. The apparatus is constructed by a hub frame, a hub shaft and a hub spacer that is assembled to the hub shaft. Providing a great improvement over the conventional design wherein a hub spacer is mounted to a hub shaft by screw means, the present invention conditioning head is assembled together by frictionally engaging a key on the hub spacer to a slot opening on the hub shaft such that any catastrophic failure due to screw breakage can be avoided. The present invention novel frictional engagement further provides a more uniform torque transfer between the two components.

18 Claims, 3 Drawing Sheets

APPARATUS AND METHOD FOR TRANSFERRING A TORQUE FROM A ROTATING HUB FRAME TO A HUB SHAFT

FIELD OF THE INVENTION

The present invention generally relates to an apparatus and a method for transferring a torque from a hub frame to a hub shaft and more particularly, relates to an apparatus and a method for transferring a torque from a rotating hub frame to a hub shaft without using connecting bolts between the hub shaft and a hub spacer such that a possible breakage of the bolts and the resultant to catastrophic failure of the apparatus can be avoided.

BACKGROUND OF THE INVENTION

Apparatus for polishing thin, flat semi-conductor wafers is well-known in the art. Such apparatus normally includes a polishing head which carries a membrane for engaging and forcing a semiconductor wafer against a wetted polishing surface, such as a polishing pad. Either the pad, or the polishing head is rotated and oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head, a wafer unload station, or a wafer load station.

More recently, chemical-mechanical polishing (CMP) apparatus has been employed in combination with a pneumatically actuated polishing head. CMP apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A schematic of a typical CMP apparatus is shown in FIGS. 1A and 1B. The apparatus 20 for chemical mechanical polishing consists of a rotating wafer holder 14 that holds the wafer 10, the appropriate slurry 24, and a polishing pad 12 which is normally mounted to a rotating table 26 by adhesive means. The polishing pad 12 is applied to the wafer surface 22 at a specific pressure. The chemical mechanical polishing method can be used to provide a planar surface on dielectric layers, on deep and shallow trenches that are filled with polysilicon or oxide, and on various metal films. CMP polishing results from a combination of chemical and mechanical effects. A possible mechanism for the CMP process involves the formation of a chemically altered layer at the surface of the material being polished. The layer is mechanically removed from the underlying bulk material. An altered layer is then regrown on the surface while the process is repeated again. For instance, in metal polishing a metal oxide may be formed and removed repeatedly.

A polishing pad is typically constructed in two layers overlying a platen with the resilient layer as the outer layer of the pad. The layers are typically made of polyurethane and may include a filler for controlling the dimensional stability of the layers. The polishing pad is usually several times the diameter of a wafer and the wafer is kept off-center on the pad to prevent polishing a non-planar surface onto the wafer. The wafer is also rotated to prevent polishing a taper into the wafer. Although the axis of rotation of the wafer and the axis of rotation of the pad are not collinear, the axes must be parallel.

The polishing pad is a consumable item used in a semiconductor wafer fabrication process. Under normal wafer fabrication conditions, the polishing pad is replaced after about 12 hours of usage. Polishing pads may be hard, incompressible pads or soft pads. For oxide polishing, hard and stiffer pads are generally used to achieve planarity. Softer pads are generally used in other polishing processes to achieve improved uniformity and smooth surface. The hard pads and the soft pads may also be combined in an arrangement of stacked pads for customized applications.

A problem frequently encountered in the use of polishing pads in oxide planarization is the rapid deterioration in oxide polishing rates with successive wafers. The cause for the deterioration is known as "pad glazing" wherein the surface of a polishing pad becomes smooth such that the pad no longer holds slurry in-between the fibers. This is a physical phenomenon on the pad surface not caused by any chemical reactions between the pad and the slurry.

To remedy the pad glazing effect, numerous techniques of pad conditioning or scrubbing have been proposed to regenerate and restore the pad surface and thereby, restoring the polishing rates of the pad. The pad conditioning techniques include the use of silicon carbide particles, diamond emery paper, blade or knife for scrapping the polishing pad surface. The goal of the conditioning process is to remove polishing debris from the pad surface, re-open the pores, and thus forms micro-scratches in the surface of the pad for improved life time. The pad conditioning process can be carried out either during a polishing process, i.e. known as concurrent conditioning, or after a polishing process.

A conventional conditioning disc for use in pad conditioning is shown in FIG. 1C in a perspective view of a CMP apparatus 50. The apparatus 50 consists of a conditioning head 52 which includes a conditioning disc 68 mounted to a hub frame 70, a polishing pad 56, and a slurry delivery arm 54 positioned over the polishing pad. The conditioning head 52 is mounted on a conditioning arm 58 which is extended over the top of the polishing pad 56 for making sweeping motion across the entire surface of the pad. The slurry delivery arm 54 is equipped with slurry dispensing nozzles 62 which are used for dispensing a slurry solution on the top surface 60 of the polishing pad 56. Surface grooves 64 are further provided in the top surface 60 to facilitate even distribution of the slurry solution and to help entrapping undesirable particles that are generated by coagulated slurry solution or any other foreign particles which have fallen on top of the polishing pad during a polishing process.

Inside the conditioning head 52, is a hub shaft 72 integrally formed with a circular disc 74 at a lower end. This is shown in FIG. 2. The hub shaft 72, when assembled with a hub spacer 76 on a flat surface 78 on the shaft can be inserted into a hub frame 70 (shown in FIG. 1) for transferring a rotational torque from the hub frame 70 to a conditioning disc 68 (shown in FIG. 1) that is mounted to a bottom surface 80 of the circular disc 74. The hub spacer 76 is fastened to the hub shaft 72 by two screws 82 and is equipped with a protruded pin 84 on a top surface 86 of the hub spacer 76. The pin 84 is used to engage a recessed slot (not shown) provided in the hub frame 70 (shown in FIG. 1) such that the hub shaft 72 can be easily assembled or disassembled. Since the conditioning disc 68 which consists of the hub shaft 72, the hub spacer 76 and the circular disc 74 operates in high torque during the pad conditioning process, the screws 82 that fasten the hub spacer 76 to the hub shaft 72 frequently break under such high torque operating conditions. When a failure, or breakage of the screws 82 occurs, the hub shaft 72 becomes loose from the hub frame 70 and causes a catastrophic failure of the conditioning head 52. Such failure leads to a total breakdown of the chemical mechanical polishing apparatus and a significant drop in the fabrication yield.

It is therefore an object of the present invention to provide an apparatus for transferring a rotational torque from a hub frame to a hub shaft that does not have the drawbacks or shortcomings of the conventional apparatus assembled together by screws.

It is another object of the present invention to provide an apparatus for transferring a rotational torque from a hub frame to a hub shaft that does not require screws for the assembly of the two parts.

It is a further object of the present invention to provide an apparatus for transferring a rotational torque from a hub frame to a hub shaft that utilizes a hub spacer compression fitted to the hub shaft for the torque transfer.

It is still another object of the present invention to provide an apparatus for transferring a rotational torque from a hub frame to a hub shaft by utilizing a hub spacer equipped with a key for intimately engaging a slot opening in the hub shaft.

It is still another object of the present invention to provide an apparatus for transferring a rotational torque from a hub frame to a hub shaft by utilizing a hub spacer situated therein-between without the need for screws for assembling the hub spacer to the hub shaft.

It is yet another object of the present invention to provide an apparatus for transferring a rotational torque from a hub frame to a hub shaft wherein the torque is effectively transferred by a key and a pin provided on the hub spacer.

It is still another further object of the present invention to provide a method for transferring a rotational torque from a hub frame to a hub shaft by first frictionally engaging a hub spacer to the hub shaft and then inserting the hub shaft into the hub frame to transfer the torque.

SUMMARY OF THE INVENTION

In accordance with the present invention, an apparatus and a method for transferring a rotational torque from a hub frame to a hub shaft for driving a pad conditioning disc are provided.

In a preferred embodiment, an apparatus for transferring a torque from a hub frame to a hub shaft is provided which includes a hub frame of generally circular configuration having a center aperture therethrough adapted for receiving a hub shaft and a hub spacer; a hub shaft that has a circular disc integrally formed at a low end and a slot opening provided in the longitudinal direction of the hub shaft, the slot opening is adapted for receiving a hub spacer; and a hub spacer of elongated shape that has on a first surface a key for intimately engaging the slot opening in the hub shaft and on a second opposing surface a pin for intimately engaging a recess in the hub frame such that a rotational torque may be transferred from the hub frame to the hub shaft.

In the apparatus for transferring a torque from a hub frame to a hub shaft, the slot opening in the hub shaft may be provided in a rectangular-shape adapted for receiving a rectangular-shaped key on the first surface of the hub spacer, or provided in a trapezoidal-shape adapted for receiving a trapezoidal-shaped key on the first surface of the hub spacer. The hub frame may further include a slot recess in the center aperture adapted for receiving the pin on the hub spacer. The hub frame transfers a rotational motion to the hub shaft for driving a conditioning disc mounted on the circular disc, or transfers an up-and-down motion to the hub shaft for engaging and disengaging a conditioning disc mounted on the circular disc to and from a polishing pad. The key on the hub spacer may have a length of at least 20 mm for transferring the rotational torque. The pin on the hub spacer may have a rectangular-shape for engaging the recess in the hub frame. The circular disc on the hub shaft may be adapted for receiving a conditioning disc thereon. The apparatus may be adapted for mounting into a chemical mechanical polishing apparatus.

The present invention is further directed to a method for transferring a torque from a hub frame to a hub shaft which can be carried out by the operating steps of first providing a hub frame of generally circular configuration that has a center aperture therein adapted for receiving a hub shaft and a hub spacer; providing a hub shaft that has a circular disc integrally formed at a lower end and a slot opening provided in the longitudinal direction of the hub shaft; providing a hub spacer of elongated shape that has on a first surface a key for intimately engaging the slot opening in the hub shaft and on a second opposing surface a pin for intimately engaging a recess in the hub frame; forming an assembly of the hub spacer and the hub shaft by frictionally engaging the key on the hub spacer to the slot opening in the hub shaft; and inserting the assembly of the hub shaft and the hub spacer into the center aperture in the hub frame such that any rotational torque of the hub frame is transferred to the hub shaft.

The method for transferring a torque from a hub frame to a hub shaft may further include the step of providing the opening in the hub shaft in a rectangular shape for receiving a rectangular-shaped key on the first surface of the hub spacer, or the step of providing the opening in the hub shaft in a trapezoidal-shape for receiving a trapezoidal-shaped key on the first surface of the hub spacer. The method may further include the step of providing a slot recess in the center aperture for receiving the pin on the hub spacer. The method may further include the step of transferring a rotational motion from the hub frame to the hub shaft and driving a conditioning disc mounted on the circular disc, or the step of transferring an up-and-down motion from the hub frame to the hub shaft and engaging or disengaging a conditioning disc mounted on the circular disc to or from a polishing pad. The method may further include the step of forming the key on the hub spacer to a length of at least 20 mm for transferring the rotational torque. The method may further include the step of providing the pin on the hub spacer with a rectangular shape for engaging the recess in the hub frame, or the step of providing the circular disc on the hub shaft to receive a conditioning disc thereon, or the step of mounting the apparatus in a chemical mechanical polishing machine.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention discloses an apparatus and a method for transferring a rotational torque from a hub frame to a hub shaft that drives a rotational disc. While the present invention apparatus and method is applicable to a torque transfer from any rotating member to a rotating shaft, it is particularly suited for transferring a rotational torque from a hub frame to a hub shaft for driving a rotating conditioning disc in a chemical mechanical polishing apparatus.

The apparatus is constructed by a hub frame, a hub shaft and a hub spacer wherein the hub spacer is first assembled to the hub shaft and then the assembly is inserted into the hub frame. Instead of a conventional method of connecting the hub spacer to the hub shaft by screws or bolts, the present invention hub spacer frictionally engages the hub shaft by compressing a key on the hub spacer into a slot opening in the hub shaft such that any failure of the apparatus due to screw breakage can be avoided.

In a chemical mechanical polishing apparatus that is equipped with in-situ pad conditioning, the pad conditioner moves up-and-down and rotates in a rotational motion by a traveling shaft to condition the polishing pad on demand. The present invention discloses the use and the incorporation of a metal key on the traveling shaft instead of screws for transferring a torque between a hub frame and a hub shaft and for allowing a linear up-and-down motion of a diamond disc holder. The present invention novel apparatus and method therefore eliminates the possibility of screw breakage in the hub spacer/hub shaft assembly which may otherwise cause catastrophic failure of the polishing system. When such failure occurs, a polished wafer must be reworked in order to be further processed.

The present invention further discloses a novel method of utilizing a metal key attachment means to ensure a torque is uniformly distributed on the key during a torque transfer from a hub frame to a hub shaft in rotating a conditioning disc. The method not only saves manpower for maintaining a pad conditioner, lowers the rework rate of wafers, but also enables a high fabrication yield of the CMP process. Instead of the screw or bolt utilized in the conventional assembly, the invention utilizes a frictional engagement between a key formed in either a rectangular or a trapezoidal shape and a slot opening formed in a corresponding shape on a hub shaft such that either a rotational torque or a linear torque may be transferred without causing failure in any of the components.

Figure 1A:
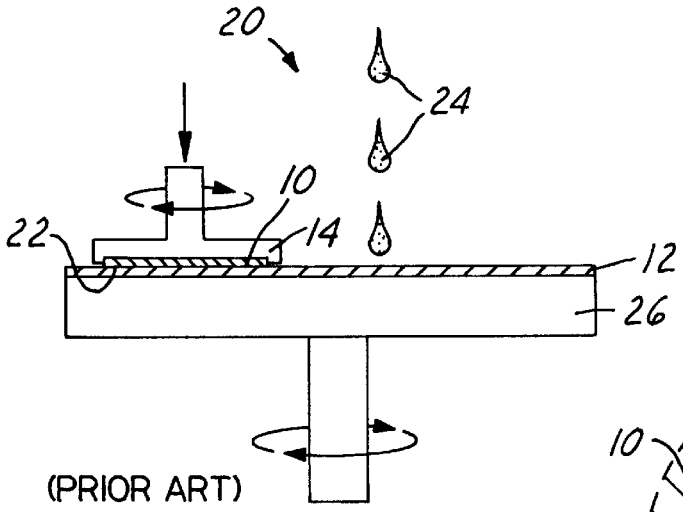
(PRIOR ART) FIG. 1A
FIG. 1A is a cross-sectional view of a conventional chemical mechanical polishing apparatus.
Figure 1B:
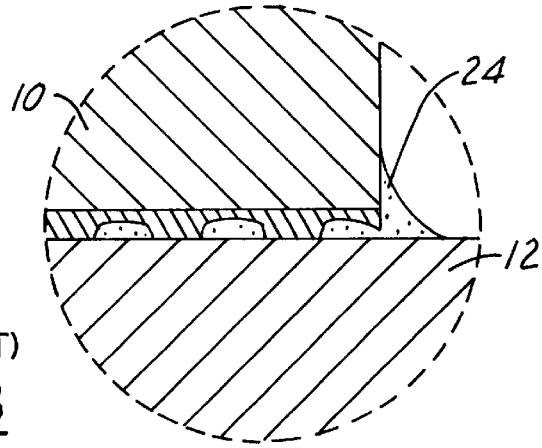
(PRIOR ART) FIG. 1B
FIG. 1B is a partial, enlarged, cross-sectional view illustrating a slurry interaction between a wafer surface and a polishing pad.
Figure 1C:
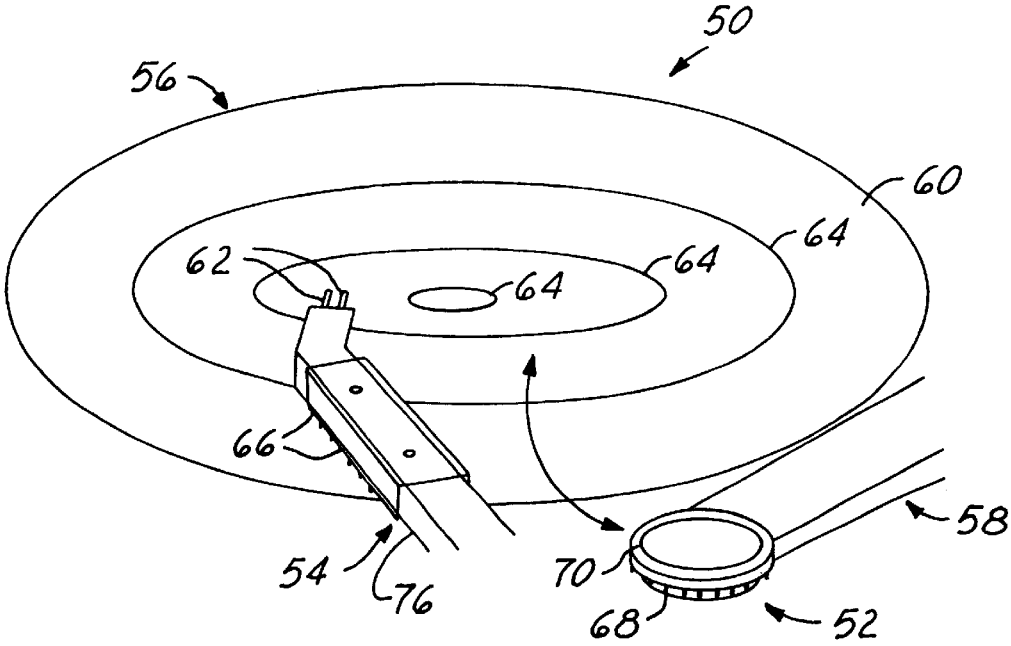
(PRIOR ART) FIG. 1C
FIG. 1C is a perspective view of a typical chemical mechanical polishing apparatus with a pad conditioning head mounted therein.
Figure 2:
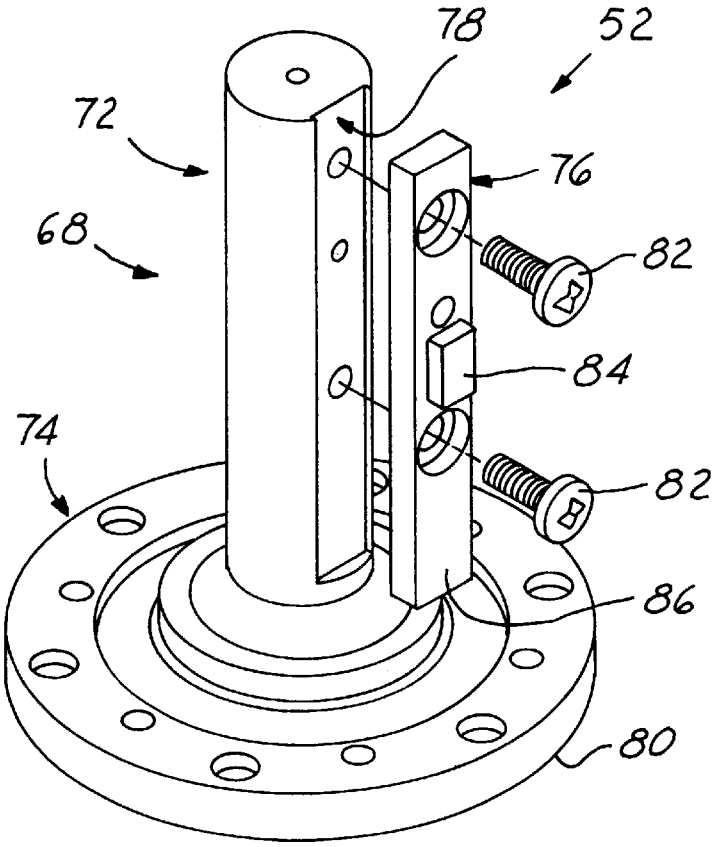
(PRIOR ART) FIG.2
FIG. 2 is a perspective view of a conventional hub shaft and hub spacer to be assembled together.
Figure 3:
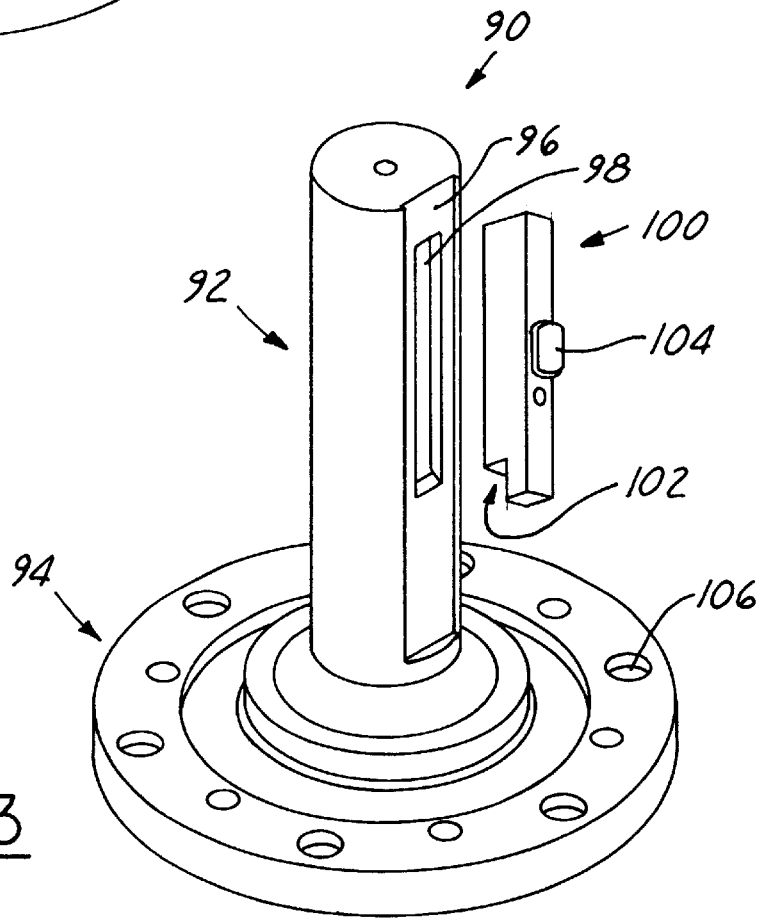
FIG. 3 is a perspective view of the present invention hub shaft and hub spacer to be assembled together.

Referring now to FIG. 3, wherein a present invention conditioning head 90 is shown. Conditioning head 90 is constructed by a hub shaft 92 attached integrally at a lower end to a circular disc 94. In a flat surface 96 formed on one side of the hub shaft 92, is provided with a slot opening 98. The slot opening may be formed either in a rectangular shape or in a trapezoidal shape corresponding to the shape of the hub spacer 100 to be inserted therein. The hub shaft 92 even though formed in some aspects similar to the conventional hub shaft 72 of FIG. 2, the assembling method to the hub spacer 100 is completely different.

As shown in FIG. 3, the hub spacer 100 is provided with a key 102 on one surface of the spacer and a pin 104 on an opposite surface of the spacer. The dimensions of the key 102 should be approximately equal to, or slightly smaller than the dimensions of the slot opening 98 provided in surface 96 of the hub shaft 92.

This allows a tight or frictional engagement between the key 102 and the slot opening 98 which can be made by easily pressing the spacer 100 onto the hub shaft 92. On an opposite surface of the hub spacer 100, is provided a protruded pin 104 adapted for engaging a slot recess in the center aperture of the hub frame (not shown) such that a rotational motion or a linear motion of the hub frame may be transferred to the hub shaft 92 through the hub spacer 100. The shape and dimensions of the pin 104 may be suitably chosen to fit a recessed slot in a center aperture of the hub frame (not shown).

In the circular disc 94 that is integrally formed with the hub shaft 92, is provided with mounting holes 106 for mounting thereto a conditioning disc, i.e. a diamond disc, used for conditioning a CMP polishing pad. The present invention novel apparatus of the conditioning head 90 therefore not only allows an easy assembly between the hub spacer 100 and the hub shaft 92, but also allows a more uniform torque transfer without causing localized stress concentration which would otherwise fail the components.

Figure 4A:
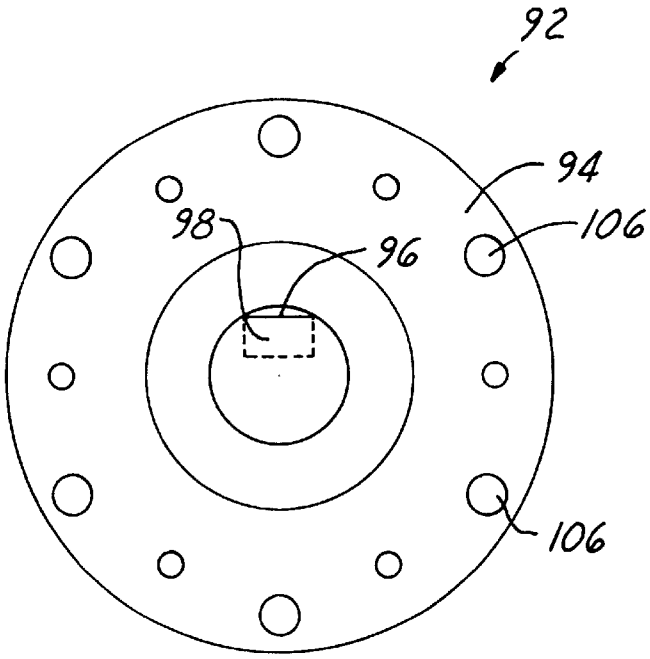
FIG. 4A is a plane view of the present invention hub shaft.
Figure 4B:
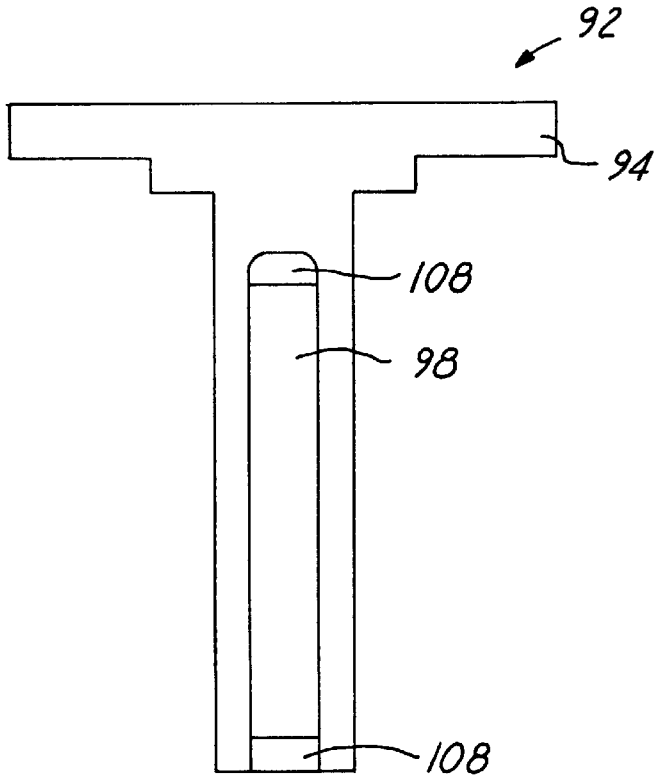
FIG. 4B is a cross-sectional view of the present invention hub shaft.

Detailed dimensions of the hub shaft 92 is further shown in FIGS. 4A and 4B in a preferred embodiment of the invention. It is seen that the thickness of the hub shaft measured to the flat surface 96 is about 9.33 mm, while the depth of the slot opening 98 is about 2.6 mm. When the slot opening 98 is provided in a trapezoidal shape, a tapered section 108 is further provided in the slot opening 98 to accommodate the sloped end surfaces of the key 102 on the hub spacer 100. The width of the slot opening 98 is normally provided in about 5 mm. The diameter of the hub shaft 92 is about 10 mm.

The present invention novel apparatus and method for transferring a rotational torque from a hub frame to a hub shaft for driving a pad conditioning disc mounted thereon is therefore amply described in the above description and in the appended drawings of FIGS. 3–4B.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows:

What is claimed is:

1. An apparatus for transferring a torque from a hub frame to a hub shaft comprising:

a hub frame of generally circular configuration having a center aperture therethrough adapted for receiving a hub shaft and a hub spacer;

a hub shaft having a circular disc integrally formed at a lower end and a slot opening provided in a longitudinal direction of the hub shaft, said slot opening adapted for receiving a hub spacer; and a hub spacer of elongated shape having on a first surface a key for intimately engaging said slot opening in said hub shaft and on a second opposing surface a pin for intimately engaging a recess in said hub frame such that a rotational torque may be transferred from said hub frame to said hub shaft, said slot opening in said hub shaft being provided in a trapezoidal shape adapted for receiving a trapezoidal-shaped key on said first surface of the hub spacer.

2. An apparatus for transferring a torque from a hub frame to a hub shaft according to claim 1, wherein said slot opening in said hub shaft being provided in a rectangular shape adapted for receiving a rectangular-shaped key on said first surface of the hub spacer.

3. An apparatus for transferring a torque from a hub frame to a hub shaft according to claim 1, wherein said hub frame further comprises a slot recess in said center aperture adapted for receiving said pin on said hub spacer.

4. An apparatus for transferring a torque from a hub frame to a hub shaft according to claim 1, wherein said hub frame transfers a rotational motion to said hub shaft for driving a conditioning disc mounted on said circular disc.

5. An apparatus for transferring a torque from a hub frame to a hub shaft according to claim 1, wherein said hub frame transfers an up-and-down motion to said hub shaft for engaging and disengaging a conditioning disc mounted on said circular disc to and from a polishing pad.

6. An apparatus for transferring a torque from a hub frame to a hub shaft according to claim 1, wherein said key on said hub spacer has a length of at least 20 mm for transferring said rotational torque.

7. An apparatus for transferring a torque from a hub frame to a hub shaft according to claim 1, wherein said pin on said hub spacer having a rectangular shape for engaging said recess in said hub frame.

8. An apparatus for transferring a torque from a hub frame to a hub shaft according to claim 1, wherein said circular disc on said hub shaft being adapted for receiving a conditioning disc thereon.

9. An apparatus for transferring a torque from a hub frame to a hub shaft according to claim 1, wherein said apparatus being adapted for mounting into a chemical mechanical polishing apparatus.

10. A method for transferring a torque from a hub frame to a hub shaft comprising the steps of:

providing a hub frame of generally circular configuration having a center aperture therethrough adapted for receiving a hub shaft and a hub spacer;

providing a hub shaft having a circular disc integrally formed at a lower end and a trapezoidal-shaped slot opening provided in the longitudinal direction of the hub shaft;

providing a hub spacer of elongated shape having on a first surface a trapezoidal-shaped key for intimately engaging said trapezoidal-shaped slot opening in said hub shaft and on a second opposing surface a pin for intimately engaging a recess in said hub frame;

forming an assembly of said hub spacer and said hub shaft by frictionally engaging said key on said hub spacer to said slot opening in said hub shaft; and inserting said assembly of hub spacer and hub shaft into said center aperture in said hub frame such that rotational torque of said hub frame is transferred to said hub shaft.

11. A method for transferring a torque from a hub frame to a hub shaft according to claim 10 further comprising the step of providing said opening in said hub shaft in a rectangular shape for receiving a rectangular-shaped key on said first surface of the hub spacer.

12. A method for transferring a torque from a hub frame to a hub shaft according to claim 10 further comprising the step of providing a slot recess in said center aperture for receiving said pin on said hub spacer.

13. A method for transferring a torque from a hub frame to a hub shaft according to claim 10 further comprising the step of transferring a rotational motion from said hub frame to said hub shaft and driving a conditioning disc mounted on said circular disc.

14. A method for transferring a torque from a hub frame to a hub shaft according to claim 10 further comprising the step of transferring an up-and-down motion from said hub frame to said hub shaft and engaging or disengaging a conditioning disc mounted on said circular disc to or from a polishing pad.

15. A method for transferring a torque from a hub frame to a hub shaft according to claim 10 further comprising the step of forming said hub spacer to a length of at least 20 mm for transferring said rotational torque.

16. A method for transferring a torque from a hub frame to a hub shaft according to claim 10 further comprising the step of providing said pin on said hub spacer in a rectangular shape for engaging said recess in said hub frame.

17. A method for transferring a torque from a hub frame to a hub shaft according to claim 10 further comprising the step of providing said circular disc on said hub shaft to receive a conditioning disc thereon.

18. A method for transferring a torque from a hub frame to a hub shaft according to claim 10 further comprising the step of mounting said apparatus in a chemical mechanical polishing machine.

* * * * *